US009575444B2

(12) United States Patent
Seshita et al.

(10) Patent No.: US 9,575,444 B2
(45) Date of Patent: Feb. 21, 2017

(54) FIXING DEVICE AND IMAGE FORMING APPARATUS INCLUDING SAME

(71) Applicants: Takuya Seshita, Kanagawa (JP); Hajime Gotoh, Kanagawa (JP); Takahiro Imada, Kanagawa (JP); Kensuke Yamaji, Kanagawa (JP); Akira Suzuki, Tokyo (JP)

(72) Inventors: Takuya Seshita, Kanagawa (JP); Hajime Gotoh, Kanagawa (JP); Takahiro Imada, Kanagawa (JP); Kensuke Yamaji, Kanagawa (JP); Akira Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/203,764

(22) Filed: Mar. 11, 2014

(65) Prior Publication Data

US 2014/0270834 A1 Sep. 18, 2014

(30) Foreign Application Priority Data

Mar. 15, 2013 (JP) ..... 2013-054120

(51) Int. Cl.
*G03G 15/20* (2006.01)

(52) U.S. Cl.
CPC . *G03G 15/2042* (2013.01); *G03G 2215/2035* (2013.01)

(58) Field of Classification Search
USPC ..... 399/68
See application file for complete search history.

(56) References Cited

U.S. PATENT DOCUMENTS 5,138,392 A * 8/1992 Kinoshita ..... G03G 15/0105 219/216
5,345,301 A * 9/1994 Satoh et al. ..... 399/330
(Continued)

FOREIGN PATENT DOCUMENTS

JP 3-145683 6/1991
JP 4-044083 2/1992
(Continued)

OTHER PUBLICATIONS

Office Action issued Oct. 25, 2016, in Japanese Patent Application No. 2013-054120.

*Primary Examiner* — Minh Phan
*Assistant Examiner* — Linda B Smith
(74) *Attorney, Agent, or Firm* — Oblon, McClelland, Maier & Neustadt, L.L.P.

(57) ABSTRACT

A fixing device in an image forming apparatus includes a rotatable fixing member; a plurality of heat sources to heat each area of the fixing member in a longitudinal direction thereof; a pressure member configured to contact the fixing member and forming a nip in association with the fixing member; a nip forming member disposed inside the fixing member and opposite the pressure member to form a fixing nip; a temperature controller to detect temperature at each area of the fixing member and control the temperature via lighting control performed by the heat sources; and a plurality of temperature sensors to detect temperature of the fixing member or the pressure member in each heating area heated by the plurality of heat sources. When a sheet size set by the image forming apparatus and an actually conveyed sheet size are different, operating speed of the device is adjusted.

7 Claims, 4 Drawing Sheets

(56) References Cited

U.S. PATENT DOCUMENTS

| | | | | |
|---|---|---|---|---|
| 2003/0118360 | A1* | 6/2003 | Joichi et al. | 399/45 |
| 2004/0131370 | A1* | 7/2004 | Yamauchi | 399/24 |
| 2005/0158066 | A1* | 7/2005 | Tomiyori | G03G 15/2042 399/68 |
| 2007/0002089 | A1* | 1/2007 | Kobayashi et al. | 347/16 |
| 2007/0201892 | A1* | 8/2007 | Ando | G03G 15/6573 399/68 |
| 2007/0292175 | A1 | 12/2007 | Shinshi | |
| 2008/0175609 | A1* | 7/2008 | Hayashi | G03G 15/65 399/45 |
| 2010/0296828 | A1* | 11/2010 | Hara et al. | 399/69 |
| 2011/0052237 | A1 | 3/2011 | Yoshikawa et al. | |
| 2011/0150518 | A1 | 6/2011 | Hase et al. | |
| 2011/0194870 | A1 | 8/2011 | Hase et al. | |
| 2011/0217056 | A1 | 9/2011 | Yoshinaga et al. | |
| 2011/0222929 | A1 | 9/2011 | Fujimoto et al. | |
| 2011/0229181 | A1 | 9/2011 | Iwaya et al. | |
| 2011/0229226 | A1 | 9/2011 | Tokuda et al. | |
| 2012/0057893 | A1* | 3/2012 | Sahara | G03G 15/657 399/67 |
| 2012/0086956 | A1* | 4/2012 | Hirao | 358/1.2 |
| 2013/0188977 | A1* | 7/2013 | Hase et al. | 399/69 |
| 2013/0195477 | A1 | 8/2013 | Seshita et al. | |
| 2013/0251390 | A1 | 9/2013 | Ishii et al. | |
| 2013/0259507 | A1* | 10/2013 | Cao et al. | 399/69 |

FOREIGN PATENT DOCUMENTS

| | | |
|---|---|---|
| JP | 2003-084623 | 3/2003 |
| JP | 2003-304355 | 10/2003 |
| JP | 2004-286922 | 10/2004 |
| JP | 2004-354416 A | 12/2004 |
| JP | 2006-163298 | 6/2006 |
| JP | 2006-171143 | 6/2006 |
| JP | 2007-334205 | 12/2007 |
| JP | 2008-292860 | 12/2008 |

* cited by examiner

FIXING DEVICE AND IMAGE FORMING APPARATUS INCLUDING SAME

CROSS-REFERENCE TO RELATED APPLICATION

The present application claims priority pursuant to 35 U.S.C. §119 from Japanese patent application number 2013-054120, filed on Mar. 15, 2013, the entire disclosure of which is incorporated by reference herein.

BACKGROUND

Technical Field

The present invention relates to an image forming apparatus such as a copier, a facsimile machine, a printer, or a multi-function apparatus having one or more capabilities of those devices.

Related Art

Demand for faster, more energy-efficient image forming apparatuses such as printers, copiers, and facsimile machines is acute. In these types of image forming apparatuses, an unfixed toner image is formed on a recording medium via image forming processes employing an image transfer method or a direct method. The recording medium may include a recording sheet, a printed sheet, a photosensitive sheet, an electrostatic recording sheet, and the like. Similarly, the image forming processes include electrophotographic recording, electrostatic recording, magnetic recording, and the like.

As a fixing device to fix an unfixed toner image, various types of fixing devices are used including a contact heating method from a heat-roller method, a film- or belt-heating method, and an electro-magnetic induction heating method.

Using such a thin fixing belt with a low thermal capacity can drastically reduce the amount of energy necessary for heating the fixing belt, and warm-up time or a first-print time can be reduced. Herein, "warm-up time" means a length of time that the fixing device takes to heat up from room temperature to a predetermined printing temperature when the power is turn on; i.e., a reload temperature capable of performing printing. "First-print time" means the time it takes from receipt of a print request and preparation for printing to completion of a printing operation and sheet discharge. The first-print time is also requested to be short. In addition, in accordance with the higher printing speed of the image forming apparatus, the number of prints per unit time increases and a required heat quantity drastically increases. In particular, upon the start of continuous printing, thermal capacity is inadequate and a so-called temperature drop occurs, which is a problem.

The warm-up time can be shortened with so-called SUrface Rapid Fixing (SURF) technology using a ceramic heater, by which a compact and efficient fixing device is realized compared to the belt configuration. However, SURF locally heats a nip portion alone and other parts are not heated. Accordingly, the belt is coolest at an inlet to the nip portion and defective fixing may occur as a result. In high-speed apparatuses in which the belt rotates fast and heat is discharged from the belt at portions other than the nip, defective fixing tends to occur more frequently.

To solve these problems, for example, JP-2007-334205-A proposes a structure using an endless belt, in which the whole belt can be heated, the first-print time from the heating standby time can be reduced, and the thermal capacity deficiency during high-speed printing is remedied, thereby obtaining optimal fixability even though mounted in a high-performance apparatus.

FIG. 1 shows an overview of the fixing device of JP-2007-334205-A. A metallic, thermally conductive pipe 2 disposed in an interior of an endless belt 1 as a fixing belt, is fixed to the fixing device so as to guide moving of the endless belt 1. A heat source 3 inside the conductive pipe 2 heats the endless belt 1 via the conductive pipe 2. The fixing device further includes a pressure roller 4 including a metal roller 4*a* and an elastic layer 4*b* and contacting the conductive pipe 2 via the endless belt 1 to thus form a nip N. The endless belt 1 moves cyclically together with the rotation of the pressure roller 4. With this structure, the entire endless belt constructing the fixing device can be heated, the first-print time from the heating standby time can be shortened, and the heat shortage in the high-speed printing can be eliminated.

Use of a structure to directly heat the endless belt enables to further save the energy and shorten the first-print time from the heating standby time. However, in a fixing device with a low thermal capacity, when sheets with a size different from the size set by the image forming apparatus is conveyed, the fixing device is not prevented from being heated excessively, thereby damaging the fixing member.

The above-described malfunction occurs due to inconsistent fixing control. Namely, although the fixing control should be performed based on the actual sheet conveyance condition, the image forming apparatus instructs the fixing device to operate under the conditions set for a different sheet size. As a result, temperature rise occurring at untargeted end portions cannot be prevented, and thus, the fixing device is heated exceeding its upper temperature limit and is eventually damaged. In such a case, the fixing control should be changed so that the end temperature rise does not occur. However, in the conventional method, the temperature rise is not detected and prevented.

More specifically, even though the image forming apparatus can set the sheet size for the sheets for fixing to be performed by the heat source disposed in the center and another heat source disposed nearer to the end than the center, because in actuality, the sheet does not pass through the heating area to be heated by the heat source disposed nearer to the end, the size of the sheet that passes through only the heating area heated by the inner heat source is set. As a result, the fixing device is damaged.

SUMMARY

Embodiments described herein are of an optimal fixing device including a rotatable fixing member; a plurality of heat sources to heat each area of the fixing member in a longitudinal direction thereof; a pressure member configured to contact the fixing member and forming a nip in association with the fixing member; a nip forming member disposed inside the fixing member and opposite the pressure member to form a fixing nip; a temperature controller to detect temperature at each area of the fixing member and control the temperature via lighting control performed by the heat sources; and a plurality of temperature sensors to detect temperature of the fixing member or the pressure member in each heating area heated by the plurality of heat sources. In the fixing member, when a sheet size set by the image forming apparatus and an actually conveyed sheet size are different, the operating speed of the fixing device is reduced. Thus, even when the sheet width actually conveyed for fixing is different from the sheet width set by the image forming apparatus, the fixing device may be prevented from being damaged.

These and other objects, features, and advantages of the present invention will become apparent upon consideration of the following description of the preferred embodiments of the present invention when taken in conjunction with the accompanying drawings.

DETAILED DESCRIPTION

Figure 1:
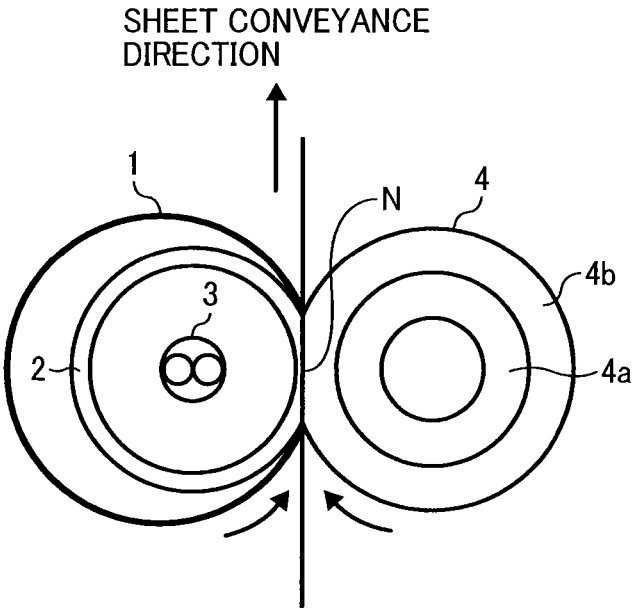
FIG. 1 BACKGROUND ART
FIG. 1 illustrates a background art fixing device.
Figure 2:
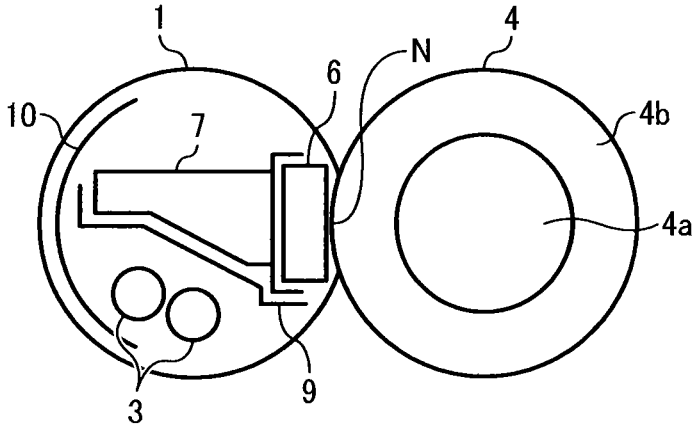
FIG. 2 illustrates a fixing device according to a first embodiment of the present invention.

Hereinafter, a fixing device according to a first embodiment of the present invention will be described with reference to FIG. 1. FIG. 2 illustrates a cross-sectional view of the fixing device according to the first embodiment.

The fixing device includes a fixing belt 1, a pressure roller 4, and a heat source 3. In the example as illustrated in FIG. 2, the heat source 3 implemented by halogen heaters directly heats the fixing belt 1 from an interior surface of the fixing belt 1. Inside the fixing belt 1 of FIG. 2, there exists a nip forming member 6 that forms a fixing nip N with the pressure roller 4 disposed opposite the nip forming member 6 via the fixing belt 1. The nip forming member 6 directly slides on the interior surface of the fixing belt 1 or indirectly slides thereon via a sheet, not shown. The heat source 3 may be a halogen heater as illustrated in FIG. 2. Alternatively, the heat source 3 may be an IH heater, a resistance heating element, or a carbon heater.

The fixing nip N has a planar shape as shown in FIG. 2. Alternatively, however, the fixing nip N may be convex or some other shape. If the shaped of the nip is convex, then because a leading end of the recording sheet when discharged from the nip is directed toward the pressure roller and separability of the sheet is improved, occurrence of a paper jam is suppressed. The fixing belt 1 is an endless belt or film preferably made of metallic materials such as nickel or stainless steel (SUS) or resinous materials such as polyimide. A surface layer of the belt includes a release layer formed of tetrafluoroethylene-perfluoroalkyl vinylether copolymer (PFA) or polytetrafluoroethylene (PTFE) that provides releasability to prevent adhesion of toner. An elastic layer made of silicon rubber, for example, may be formed between a base of the belt and the PFA or PTFE layer. If the pressure roller 4 does not include a silicon rubber layer, the thermal capacity of the pressure roller 4 is reduced and the fixing property is improved. However, when the unfixed toner is pressed and fixed, minute concavity and convexity of the belt surface is transferred to the image and the solid image portion may include uneven glossiness like an orange peel. To improve this, a silicon rubber layer is preferably disposed with a depth of 100 μm or more that deforms to absorb the convexo-cavities in the belt surface.

A stay 7 is disposed inside the fixing belt 1. The stay 7 prevents the nip forming member 6 that receives pressure from the pressure roller from deforming, so that an even nip width can be obtained along an axis direction of the pressure roller. The stay 7 is fixed on retainers or flanges, not shown, at both ends of the fixing device. In addition, a reflective member 9 is disposed between the heat source 3 and the stay 7 to prevent waste of energy due to radiation of heat from the heat source 3 to the stay 7. Alternatively, instead of disposing the reflective member 9, the surface of the stay 7 may be insulated or given a mirror finish so that a similar effect can be obtained.

The pressure roller 4 includes a metal core 4*a* and an elastic layer 4*b* formed of elastic rubber. A release layer (formed of PFA or PTFE) for the purpose of improving releasability, not shown, is disposed on the surface of the elastic layer 4*b*. A driving force is transmitted to the pressure roller 4 via a gear from a motor, both not shown, disposed in the image forming apparatus, and the pressure roller 4 rotates. In addition, the pressure roller 4 is pressed against the fixing belt 1 via a spring, not shown, and the elastic layer 4*b* is deformed with pressure to thus form a nip with a predetermined width between the fixing belt 1 and the pressure roller 4. The pressure roller 4 may be a hollow roller and may include a heat source such as a halogen heater. The elastic layer 4*b* may be formed of a solid rubber but may use a sponge rubber when the pressure roller 4 does not include a built-in heater. The sponge rubber is more preferable because it increases heat insulating property and prevents the heat of the fixing belt 1 from being absorbed.

The fixing belt 1 rotates by being driven by the pressure roller 4. As illustrated in FIG. 2, the pressure roller 4 rotates driven by the drive source, not shown, and the driving force of the pressure roller 4 is transmitted to the fixing belt 1 at the nip N, so that the fixing belt 1 rotates. The fixing belt 1 is rotatable while sandwiched in the nip N, and rotates by being guided by the flanges at both ends when the nip N is not formed. With such a structure, a fixing device with a quick warm-up time may be formed at low cost.

In the structure illustrated in FIG. 2, the heat source 3 includes two halogen heaters. The pressure roller 4 includes a metal core 4*a* and the elastic layer 4*b*. Inside the fixing belt 1, the nip forming member 6, the stay 7 to support the nip forming member 6, the reflective member 9, and a light shield 10 are disposed, and N denotes the nip.

Structure of the fixing device will be described in detail referring to FIG. 3.

Figure 3:
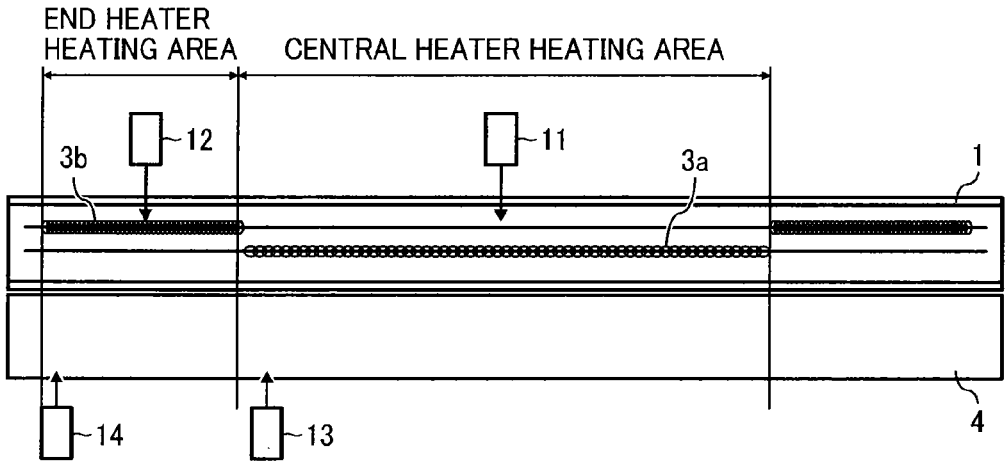
FIG. 3 illustrates a fixing device according to the first embodiment of the present invention in the longitudinal direction thereof.

FIG. 3 is a schematic view seen from below the fixing device in FIG. 2 and illustrates positions of the heat source 3, and its heating width, disposed in the longitudinal direction of the endless fixing belt 1 that constitutes a fixing sleeve and of temperature sensors to control the temperature at each disposed position.

A central area of the fixing belt 1 is heated by a central heater 3*a* and a central temperature sensor 11 detects the temperature of the central area of the fixing belt 1. Both end areas of the fixing belt 1 are heated by end heaters 3*b*, 3*b* and end temperature sensors 12 detect the temperature of both ends of the fixing belt 1, respectively, and the temperature is controlled by the heaters 3*a* and 3*b* based on the detected temperature.

On the other hand, the surface temperature of the pressure roller 4 disposed opposite the fixing belt 1 is detected by a central pressure sensor 13 disposed at one end of the central heating area and an end temperature sensor 14 disposed at one end of the end heating area. With such a structure, the fixing device is constructed.

Figure 4:
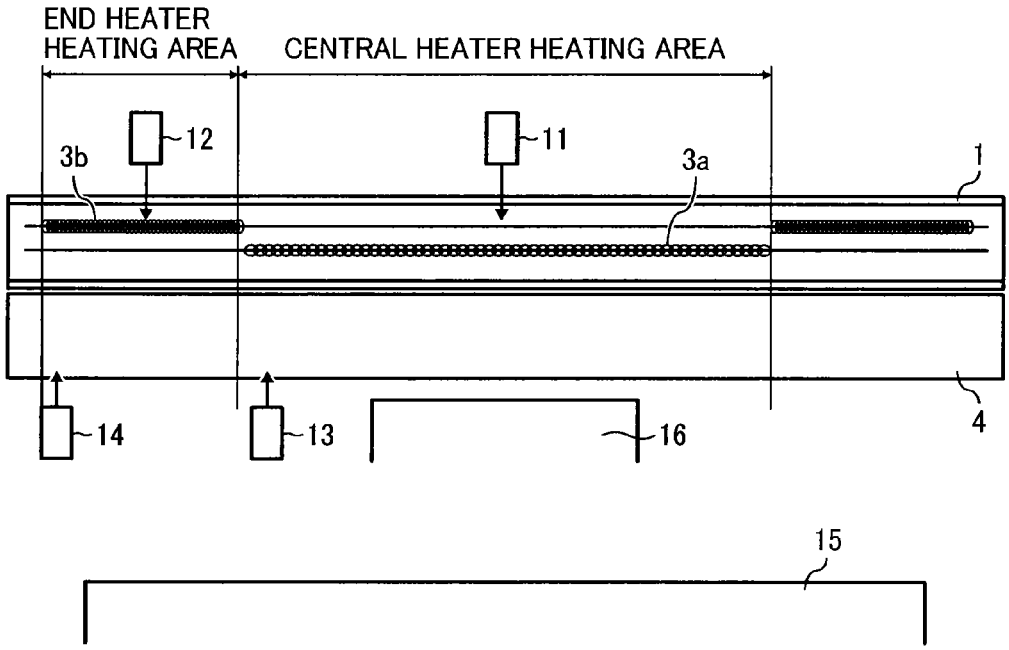
FIG. 4 illustrates the fixing device in the longitudinal direction thereof and a relation between the fixing device and a width of the paper.

FIG. 4 illustrates the fixing device in the longitudinal direction thereof and a relation between the fixing device and a width of the paper. The image forming apparatus instructs a sheet width of the recording sheet to the fixing device. When the instructed sheet width matches the sheet width actually conveyed to the fixing device, printing operation is performed as follows. It is to be noted that the length in the sheet conveyance direction is defined as a sheet length and the length in the direction perpendicular to the sheet conveyance direction is defined as a sheet width.

If the printed sheet has a width of which end comes nearer the center of the heating width than the position of the central pressure sensor 13, the operating speed of the fixing device is changed based on the detected temperature by the central pressure sensor 13. If the printed sheet has a width of which end comes outside the central pressure sensor 13 and at an inner side of the end temperature sensor 14, the operating speed of the fixing device is reduced based on the detected temperature at the inner side of the end temperature sensor 14. If the printed sheet has a width of which end comes outside the end temperature sensors 12 and at an inner side of the end temperature sensor 14, the operating speed of the fixing device is reduced based on the detected temperature by the end temperature sensor 14.

Even though the printed sheet width for fixing in the thus-constructed fixing device is set using the central heating area and the end heating areas, if the actually conveyed sheet width is the central heating area alone, positions of each heating area and the temperature sensors are as illustrated in FIG. 4. The sheet width set by a user is 15, and the actually conveyed sheet width for the printed sheet is 16. In this case, because the sheet does not pass through the heating area, the supplied heat amount is small. In addition, temperature rises at end portions, that is, outside the actually-conveyed printed sheet and at lateral ends of the central heating area. Herein, the operating speed of the fixing device is reduced to suppress the temperature rise at both lateral ends.

When the sheet width set by the image forming apparatus and the actually conveyed sheet width are different, it can be determined that the sheet widths do not match because the supplied heat amount of the heat source disposed at both ends is below the set value. Herein, because the supplied heat amount can be detected based on lighting duty, that is, a ratio of the lighting time related to the lighting cycle, the lighting duty is used as a control parameter in controlling the heat amount, and the heat amount can be detected by detecting that the heating duty is below the predetermined value. However, because the supplied heat amount based on the lighting duty is affected by power density (W/mm) of each heat source, start and stop of the power supply, and voltages, those elements should be considered to accurately detect the supplied heat amount.

In the configuration of the fixing device according to the present embodiment, when the rated voltage is input, the lighting duty of the end heat sources is below 15% and it can be determined that the sheet width set by the image forming apparatus and the actually conveyed sheet width are different. In this case, the operating speed of the fixing device should be lowered.

Although the determination that the sheet width set by the image forming apparatus and the actually conveyed sheet width are different can be made as above, the same determination can be made by an alternative way as follows.

If a state in which the lighting duty of the end heat source is below the predetermined amount continues for a predetermined time period, it can be determined that the sheet width instructed by the image forming apparatus and the actually conveyed sheet width are different. The advantage of this approach is that, even when the sheet width is appropriately set, temperature ripple inevitably occurs and the lighting duty may suddenly and drastically drop as a result. In this case, when the heat amount is controlled depending solely on whether the lighting duty is below the predetermined value or not, even though the sheet width set by the image forming apparatus and the actually conveyed sheet width match the operating speed of the fixing device is reduced, which drastically degrades productivity. To prevent such a malfunction, when the lighting duty below the predetermined value continues for a predetermined time period, the operating speed of the fixing device is reduced, thereby preventing the malfunction. In the present embodiment, the above predetermined time of the lighting duty is approximately five seconds.

As an alternative method, when the difference between the lighting duty of the end heat source and that of the central heat source exceeds a predetermined value, it can be determined that the sheet width set by the image forming apparatus and the actually conveyed sheet width are different. In such a case, the operating speed of the fixing device is reduced only when the above state continues for a predetermined period or more. Thus, malfunction of the image forming apparatus occurring when the sheet width set by the image forming apparatus and the actually conveyed sheet width are different can be reliably prevented.

Alternatively, when the sheet width set by the image forming apparatus and the actually conveyed sheet width are both correctly set, because the sheet always passes through the temperature sensor (i.e., the central pressure sensor 13 in FIG. 4), the temperature detected by the central pressure sensor 13 is low. On the other hand, when the sheet width set by the image forming apparatus and the actually conveyed sheet width are different and the actually conveyed sheet width is narrower, so that the central pressure sensor 13 is outside the width of the printed sheet, the temperature at both ends increases and the temperature detected by the central pressure sensor 13 is high. Using this difference, it can be detected that the sheet width set by the image forming apparatus is different from the actually conveyed sheet width.

Specifically, when the sheet width set by the image forming apparatus and the actually conveyed sheet width are coincidentally set, the temperature detected by the central pressure sensor 13 disposed within the sheet conveyance area increases up to only 130 degrees C. at most. On the other hand, when the sheet width set by the image forming apparatus and the actually conveyed sheet width are different and the temperature rise at both ends needs to be suppressed, the temperature at both ends increases up to approximately 170 degrees C. Accordingly, when the temperature detected by the central pressure sensor 13 becomes 170 degrees C., the operating speed of the fixing device needs to be reduced.

In addition, when the temperature detected by the central pressure sensor 13 is employed as a determination factor, the operating speed of the fixing device is reduced, for example, if the interval of the printed sheet becomes long. This is because it is determined that the sheet width set by the image forming apparatus and the actually set sheet width, are different, which causes a malfunction. The interval between conveyed sheets becomes long when the data amount is heavy and it takes time to transfer such data, when various adjustments have been made on the image density or positional shift and the like, or when duplex printing is instructed. In such a case, because the fixing member is controlled to obtain the fixable temperature, the temperature of the pressure member may tend to be heated excessively. To prevent malfunction, the operating speed of the fixing device should be reduced in accordance with the detected temperature by the pressure central sensor only when the fixing device actually performs fixing operation.

When the printing operation restarts after an interval between sheets, the temperature of the pressure roller 4 rises during the interval and starts to drop immediately after the sheet conveyance, and becomes the minimum temperature during the sheet conveyance in five seconds or so. Specifically, the temperature of the pressure roller 4 remains high for an initial five seconds when the operating speed of the fixing device is reduced from immediately after the start of sheet conveyance during the sheet conveyance, and during that time, the image forming apparatus may malfunction to reduce productivity. As a result, to prevent malfunction, it is necessary not to reduce the operating speed of the fixing device for five seconds from the start of sheet conveyance. Because the above conditions vary depending on the structure of the fixing device, such as size and material, suitable values should be obtained empirically in designing the fixing device.

The above description has been made relating to the sheet width; however, when the sheet length in the sheet conveyance direction is wrongly set, the fixing member may be damaged similarly. When the actual sheet length is longer than the length set by the image forming apparatus, the heat amount to fix the length of sheet that is longer than that set by the image forming apparatus is supplied to the fixing device, thereby heating the both ends more. As a result, the operating speed of the fixing device is not reduced, so that the fixing device is damaged. If the length of the conveyed sheet is longer than the length set by the image forming apparatus, the temperature rise at both ends is large, so that the temperature rising curve is steep. If the temperature rising curve or the speed is steeper than the previously-set temperature rising curve, the sheet length set by the image forming apparatus and the actual sheet length are different. Specifically, it can be determined that the actual sheet length is longer. In such a case, the reduction in operating speed can be adjusted so that the fixing member is kept at lower than the upper temperature limit, to thus prevent the fixing member from being damaged.

The temperature rising speed at both ends can be obtained from the temperature rise in the time unit and all sensors may be used for that purpose.

Herein, the temperature rise time or speed may be affected by heat storage status of the unit, environmental temperature, sheet temperature, and source voltage. As a result, even though the sheet length set by the image forming apparatus coincides with the actual sheet length, the reduction in operating speed of the fixing device may be inadvertently performed due to the above factors, thereby degrading the operability of the users. Thus, to prevent such a malfunction considering the above, the temperature rise speed under each condition is previously set and the operating speed of the fixing device is reduced when the temperature rise speed increases and exceeds the preset speed under each condition.

The present invention is effective when either or both of the sheet width and the sheet length are different. However, when the inconsistence of the sheet width and that the temperature rise speed is more than the predetermined value are simultaneously detected, the operation to be performed when the inconsistence of the sheet width is detected is preferably performed in priority.

Figure 5:
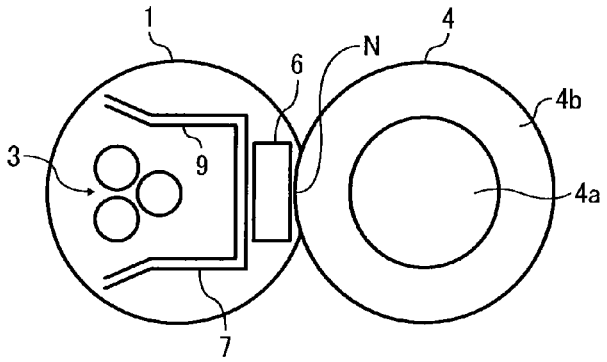
FIG. 5 illustrates a fixing device employing plural heaters according to a second embodiment of the present invention.
Figure 6:
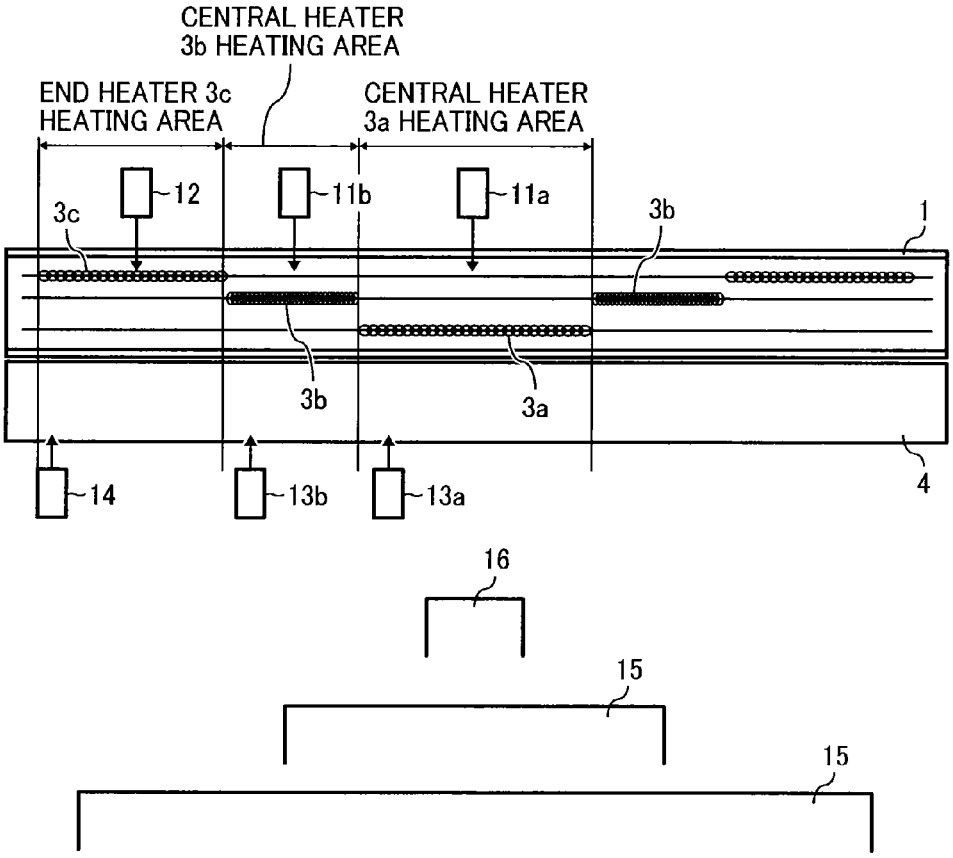
FIG. 6 illustrates the fixing device of FIG. 5 in the longitudinal direction thereof and a relation between the fixing device and the width of the paper.

FIGS. 5 and 6 illustrate schematic views of the fixing device according to a second embodiment of the present invention. In the present embodiment, the heat source 3 includes three halogen heaters. As illustrated in FIG. 6, the fixing device includes central heaters 3*a*, 3*b*, 3*b*, and end heaters 3*c*, 3*c*. Each heater is separately disposed in different heating areas. Pressure central sensors 11*a*, 11*b*, 13*a*, 13*b*, and an end temperature sensor 14 to detect the temperature of the pressure roller are disposed at an end in each heating area of the heaters.

In the above structure, similar problems will occur. When a heater disposed nearer to the both ends of the heating area should have been employed according to the sheet width set by a user, the actually conveyed sheet width employs only a heater disposed at an inner side. In such a case, the fixing member will be damaged. In the structure as above, the present invention may prevent the fixing member from being damages. The sheet width set by the user is 15, and the actually conveyed sheet width for the printed sheet is 16.

Figure 7:
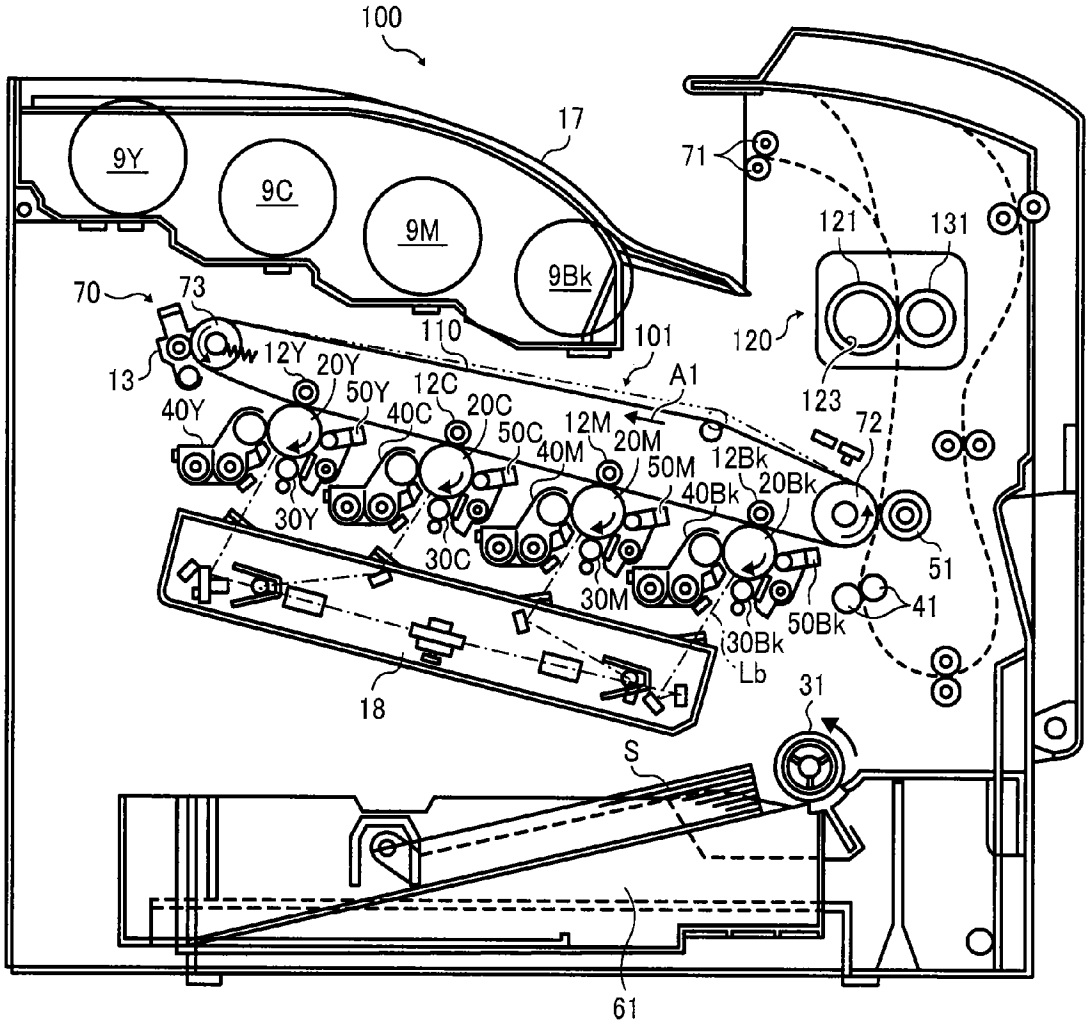
FIG. 7 is a schematic view of an image forming apparatus employing a fixing device according the present invention.

FIG. 7 illustrates an image forming apparatus incorporating the fixing device according to the above described embodiments of the present invention.

The image forming apparatus 100 is a tandem-type color printer in which image forming units each forming a different color image, are aligned along a stretching direction of a belt. However, the present invention is not limited to this method, and without limiting to the printer, the present invention may be employed in the copier and the facsimile machine.

As illustrated in FIG. 7, the image forming apparatus 100 includes photoreceptor drum 20Y, 20C, 20M, or 20Bk each as an image carrier to form an image of a color corresponding to a color decomposed from a print-target image into each color of yellow, cyan, magenta, and black. The photoreceptor drum 20Y, 20C, 20M, or 20Bk are aligned in a so-called tandem method.

The image forming apparatus 100 in FIG. 7 includes the photoreceptor drums 20Y, 20C, 20M, or 20Bk. Each visible toner image formed on each of the photoreceptor drums 20Y, 20C, 20M, and 20Bk is primarily and superimposedly transferred on an endless, intermediate transfer body (herein, to be referred to as a transfer belt) 110 movable opposing to each photoreceptor drum in Arrow A1 direction. The thus-transferred toner image is secondarily transferred en bloc to a recording sheet S.

Various devices to perform respective imaging process according to a rotation of the photoreceptor drum are disposed around each photoreceptor drum. A description will be given taking the photoreceptor drum 20Bk which performs formation of a black image as a representative. Along the rotation direction of the photoreceptor drum 20Bk, a charger 30Bk, a developing device 40Bk, a primary transfer roller 12Bk, and a cleaning device 50Bk are disposed. An optical writing device 80 is used for writing to be performed after charging.

Superimposition to the transfer belt 110 is performed as follows. Each visible image formed on each photoreceptor drum 20Y to 20Bk is so transferred to the transfer belt 110 as to be superimposed on a same position on the transfer belt 110 while the transfer belt 110 is moving in A1 direction. The above primary transfer is performed by application of voltage by each primary transfer roller 12Y to 12Bk disposed opposite each photoreceptor drum 20Y to 20Bk with the transfer belt 110 in between and the voltage application is performed from upstream to downstream in A1 direction at a shifted time. Each photoreceptor drum 20Y, 20C, 20M, or 20Bk is disposed in that order from upstream to downstream in A1 direction. Each photoreceptor drum 20Y, 20C, 20M, or 20Bk is mounted in a corresponding image station that forms images of each color of yellow, cyan, magenta, and black.

The image forming apparatus 100 includes four image stations each performing imaging processes for respective colors. The image forming apparatus 100 includes a transfer belt unit 101 disposed above each photoreceptor drum 20Y to 20Bk and including the transfer belt 110 and the primary transfer rollers 12Y to 12Bk. Further, the image forming apparatus 100 includes a secondary transfer roller 5 disposed opposite the transfer belt 110 and rotating driven by the transfer belt 110. In addition, the image forming apparatus 100 includes a belt cleaning device 131 disposed opposite the transfer belt 110 and to clean the surface of the transfer belt 110. In addition, the image forming apparatus 100 includes the optical writing device 80 disposed below the four image stations.

The optical writing device 80 includes a semiconductor laser as a light source, a coupling lens, an fθ lens, a toroidal lens, a folding mirror, and a polygon mirror as a deflection means. The optical writing device 8 emits a writing light Lb corresponding to each color to the photoreceptor drum 20 and forms an electrostatic latent image on each photoreceptor drum 20. In FIG. 7, only the writing light Lb for the black image station is coded, but the other image station is similarly configured.

A sheet feeder 61 is disposed in the bottom of the image forming apparatus 100. The sheet feeder 61 as a paper tray contains recording sheets S each of which will be conveyed toward a portion between the photoreceptor drums 20Y to 20Bk and the transfer belt 11. The recording sheet S conveyed from the sheet feeder 61 is sent, via a registration roller pair 4, to a transfer portion between each photoreceptor drum 20Y to 20Bk and the transfer belt 110 at a predetermined time matched with the toner image formed by the image station. A sensor, not shown, detects that a leading end of the recording sheet S arrives at the registration roller pair 4.

The image forming apparatus 100 includes a fixing device 120, employing a roller fixing method, which fixes the toner image carried on the recording sheet S onto it. The image forming apparatus 100 further includes a sheet discharge roller pair 71 to discharge the recording sheet S onto which the toner image has been fixed, to outside the apparatus; and a sheet discharge tray 17 disposed above the apparatus and on which the discharged sheet is stacked. Toner bottles 9Y to 9Bk each containing toner of one of colors, i.e., yellow, cyan, magenta, and black are disposed below the sheet discharge tray 17.

The transfer belt unit 101 includes, other than the transfer belt 110 and the primary transfer rollers 12Y, 12C, 12M, and 12Bk, a drive roller 72 and a driven roller 73. The transfer belt 110 is stretched around the drive roller 72 and the driven roller 73. The driven roller 73 serves also as a biasing force applying member against the transfer belt 110. Thus, the driven roller 73 is provided with a biasing member, such as a spring. A transfer device 70 is thus constructed of the transfer belt unit 101, the primary transfer rollers 12Y to 12Bk, a secondary transfer roller 5, and a cleaning device 131.

The sheet feeder 61 includes a sheet feed roller 31 that is disposed in the bottom of the body of the image forming apparatus 100 and contacts an upper surface of the topmost recording sheet S. When the sheet feed roller 31 is driven to rotate in the counterclockwise direction, the topmost recording sheet S is caused to be conveyed to the registration roller pair 4.

Although not illustrated in detail, the cleaning device 131 disposed in the transfer device 70 includes a cleaning brush and a cleaning blade, both of which are disposed opposite and contact the transfer belt 110. The cleaning brush and blade scrape and remove foreign particles such as residual toner remaining on the transfer belt 110 to thus clean the transfer belt 11.

The cleaning device 131 further includes a discharging means, not shown, to collect and waste the residual toner removed from the transfer belt 110.

Each of the functions of the described embodiments—in particular, the reduction in the operating speed of the fixing device—may be implemented by one or more processing circuits. A processing circuit includes a programmed processor, as a processor includes circuitry. A processing circuit also includes devices such as an application specific integrated circuit (ASIC) and conventional circuit components arranged to perform the recited functions.

Additional modifications and variations of the present invention are possible in light of the above teachings. It is therefore to be understood that, within the scope of the appended claims, the invention may be practiced other than as specifically described herein.

What is claimed is:

1. A fixing device in an image forming apparatus comprising:

a rotatable fixing member;

a plurality of heat sources to heat each area of the fixing member in a longitudinal direction thereof;

a pressure member configured to contact the fixing member and form a nip in association with the fixing member;

a nip forming member disposed inside the fixing member and opposite the pressure member to form a fixing nip;

a temperature controller to detect temperature at each area of the fixing member and control the temperature via lighting performed by the heat sources; and a plurality of temperature sensors to detect temperature of the fixing member or the pressure member in each heating area heated by the plurality of heat sources, wherein, when a sheet size set by a user of the image forming apparatus and an actually conveyed sheet size are different, operating speed of the fixing device is adjusted.

2. The fixing device as claimed in claim 1, wherein, when the sheet size set by the user of the image forming apparatus is smaller than the actually conveyed sheet size, the operating speed of the fixing device is reduced.

3. The fixing device as claimed in claim 1, wherein, when the temperature sensor detects a temperature exceeding a predetermined value during printing, the operating speed of the fixing device is adjusted.

4. The fixing device as claimed in claim 2, wherein, in a case in which a supplied heat amount of an end heat source in the longitudinal direction of the fixing member is below a predetermined amount continues for a predetermined time period, the operating speed of the fixing device is reduced.

5. The fixing device as claimed in claim 2, wherein, in a case in which the difference between the supplied heat amount during printing to the heat source disposed in a centermost portion of the fixing member in the longitudinal direction and the supplied heat amount to the end heat source exceeds a predetermined value continues for more than a predetermined time period, the operating speed of the fixing device is adjusted.

6. The fixing device as claimed in claim 2, wherein the operating speed of the fixing device is adjusted in at least one of:

(1) a state in which a supplied heat amount, during printing, to the heat source disposed at an end of the fixing member in the longitudinal direction, is below a predetermined amount continues for more than a predetermined time period;

(2) a state in which difference between the supplied heat amount during the printing to the heat source disposed in a centermost portion of the fixing member in the longitudinal direction and the supplied heat amount to the heat source disposed at an end of the fixing member exceeds a predetermined value continues for more than the predetermined time period; and (3) when the temperature sensor detects a temperature exceeding the predetermined value during printing.

7. An image forming apparatus comprising the fixing device as claimed in claim 1.

* * * * *